US010145043B2

(12) United States Patent
Conti et al.

(10) Patent No.: US 10,145,043 B2
(45) Date of Patent: Dec. 4, 2018

(54) METHOD AND MACHINE FOR KNITTING TUBULAR KNITTED ARTICLES

(71) Applicant: STÄUBLI ITALIA S.P.A., Carate Brianza (MB) (IT)

(72) Inventors: Gianni Conti, Florence (IT); Massimo Venni, Florence (IT); Mauro Barbieri, Chiari (IT)

(73) Assignee: STÄUBLI ITALIA S.P.A., Carate Brianza (MB) (IT)

( * ) Notice: Subject to any disclaimer, the term of this patent is extended or adjusted under 35 U.S.C. 154(b) by 54 days.

(21) Appl. No.: 15/517,722

(22) PCT Filed: Oct. 2, 2015

(86) PCT No.: PCT/EP2015/072879

§ 371 (c)(1),
(2) Date: Apr. 7, 2017

(87) PCT Pub. No.: WO2016/055390

PCT Pub. Date: Apr. 14, 2016

(65) Prior Publication Data

US 2017/0241052 A1 Aug. 24, 2017

(30) Foreign Application Priority Data

Oct. 10, 2014 (IT) ..... FI2014A0231

(51) Int. Cl.
*D04B 9/40* (2006.01)
*D04B 1/10* (2006.01)
*D04B 15/02* (2006.01)

(52) U.S. Cl.
CPC ..... *D04B 9/40* (2013.01); *D04B 1/108* (2013.01); *D04B 15/02* (2013.01)

(58) Field of Classification Search
CPC . D04B 9/40; D04B 1/108; D04B 1/26; D04B 15/02
See application file for complete search history.

(56) References Cited

U.S. PATENT DOCUMENTS 1,068,853 A 7/1913 Butz
1,188,125 A 6/1916 Williams
(Continued)

FOREIGN PATENT DOCUMENTS

EP 2 377 979 A1 10/2011
IT PI20070091 A1 2/2009
(Continued)

*Primary Examiner* — Danny Worrell
(74) *Attorney, Agent, or Firm* — McGlew and Tuttle, P.C.

(57) ABSTRACT

The method for manufacturing tubular knitted articles (M) comprises the steps of: a) knitting a tubular knitted article (M) with the needle cylinder (3); b) transferring loops (MA) of a last-formed course of loops from the needles (5) of the needle cylinder (3) onto the pick-up members (27A, 27B) of a transfer unit (21), divided into two circular half-rings (25A, 25B, 27A, 27B) which can be overturned over each other; c) overturning one of the circular half-rings (25A, 25B, 27A, 27B) of pick-up members (27B) onto the other so as to arrange two edge portions of the final edge of the tubular knitted article (M) one onto the other; d) joining the two edge portions to one another by means of joining stitches (A, B, C, D) formed in intermediate spaces between adjacent pick-up members (27A), whereon the knitted tubular article (M) is retained; e) unloading the knitted tubular article (M) with the closed toe from the transfer unit (21).

13 Claims, 16 Drawing Sheets

(56) References Cited

U.S. PATENT DOCUMENTS

| | | | | |
|---|---|---|---|---|
| 2,379,649 | A | 7/1945 | Nebel | |
| 3,046,768 | A | 7/1962 | Frantisek | |
| 3,430,462 | A | 3/1969 | Nebel et al. | |
| 3,470,715 | A | 10/1969 | Parthum | |
| 3,751,942 | A | 8/1973 | Uhlir | |
| 4,005,589 | A | 2/1977 | Uhlir | |
| 5,115,650 | A | 5/1992 | Patrick et al. | |
| 5,426,957 | A | 6/1995 | Yamaoka | |
| 5,551,260 | A | 9/1996 | Frullini et al. | |
| 5,570,591 | A * | 11/1996 | Frullini | D04B 9/56 66/148 |
| 5,992,182 | A | 11/1999 | Lonati et al. | |
| 6,158,252 | A | 12/2000 | Conti | |
| 6,591,637 | B2 | 7/2003 | Jürgens | |
| 7,900,483 | B2 * | 3/2011 | Conti | D04B 15/02 66/148 |
| 10,011,928 | B2 * | 7/2018 | Lonati | D05B 23/009 |
| 2001/0039816 | A1 * | 11/2001 | Fujiwara | D04B 15/06 66/13 |
| 2006/0144095 | A1 | 7/2006 | Frullini et al. | |
| 2010/0199723 | A1 | 8/2010 | Conti | |

FOREIGN PATENT DOCUMENTS

| | | | |
|---|---|---|---|
| WO | 2004/035864 | A2 | 4/2004 |
| WO | 2004/035894 | A1 | 4/2004 |
| WO | 2010/086708 | A1 | 8/2010 |

* cited by examiner

A
21

25A
25B
27A
B-B
27B
29A
29B
23A
23B
M
31
1
15
15
5
3
5
7
B
11
9
11
A

METHOD AND MACHINE FOR KNITTING TUBULAR KNITTED ARTICLES

TECHNICAL FIELD

The present invention relates the methods and machines for producing tubular knitted articles, especially socks and stockings.

STATE OF THE ART

For producing tubular articles, especially socks, circular knitting machines are used that knit the article starting from the elastic border up to the opposite end defining the edges that, once sewn or linked together, form the toe of the sock. In traditional machines, once the article has been knitted it is unloaded with the open toe, and the articles coming from one or more circular knitting machines are then transferred to a sewing machine. An operator picks up single articles, holding them at the end of the toe, and introduces them into the sewing machine to close the end of the toe remained open after knitting by means of the circular knitting machine. This traditional method implies a lot of labor and therefore high production costs.

Devices and circular knitting machines have been studied to automatically pick up the tubular articles from the needle cylinder of a circular knitting machine and transfer them automatically to a linking or sewing machine outside of the knitting machine. WO2004/035864 discloses a device for automatically transferring and sewing or linking the toe of a tubular article produced with a circular knitting machine.

WO2010/086708 describes a different, simpler and more efficient system for transferring the tubular article from the knitting machine to the sewing machine.

In these known systems, a pick-up member is provided for the tubular article, comprising a plurality of pick-up hooks arranged according to a circular ring subdivided into two circular half-rings that can be overturned over each other. The pick-up member is positioned coaxially with the needle cylinder of the knitting machine, arranging the pick-up hooks so that they can receive the tubular article. In WO2004/035894 the pick-up member is such that each single stitch of the last course engaged by a respective needle of the needle cylinder of the knitting machine is transferred onto a respective pick-up hook. It is therefore possible to sew or link the tubular knitted article outside of the circular knitting machine. The article thus obtained has high quality but the linking process is complex and long-lasting; furthermore the device for picking the tubular article up is particularly complex and expensive.

The machine described in WO2010/086708 has a pick-up member with a plurality of fixed pick-up hooks entering the last stitches of the tubular article when the last course of stitches of said tubular article is still engaged by the needles of the circular knitting machine. The pick-up movement of the hooks is provided by moving the pick-up member towards the loop formation plane with a movement parallel to the axis of the needle cylinder, so that the hooks enter the fabric of the tubular knitted article. In a subsequent step, the stitches of the last course are removed from the needles and the tubular knitted article remains engaged by the pick-up hooks of the pick-up member that removes the article from the needle cylinder and transfers it to a sewing or linking machine outside.

Italian patent application PI2007A000091 discloses a circular knitting machine with a pick-up member provided with a plurality of fixed pick-up hooks arranged according to a circular shape having a diameter that is smaller than the diameter of the circular needle bed formed by the needles of the machine cylinder. The tubular article is transferred from the needle cylinder to the ring of hooks removing the last course from the needles so that, due to the elasticity of the yarn with which the last course has been formed, it shrinks and engages with the pick-up hooks.

U.S. Pat. No. 6,591,637 discloses a device to pick up a tubular knitted article from the needle cylinder of a knitting machine and to close the toe of the article by sewing or linking it.

U.S. Pat. No. 5,551,260 discloses a method and a device to pick up individual stitches from a needle cylinder of a knitting machine and to sew or link said stitches together, overturning a circular half-ring of pick-up hooks onto a complementary half-ring of hooks.

U.S. Pat. No. 1,188,125 and U.S. Pat. No. 1,068,853 disclose further mechanisms for picking up the stitches from the needles of a knitting machine and for overturning two semi-courses of stitches to perform linking.

All these systems have drawbacks due to the complexity of the devices for handling the tubular knitted article or due to low reliability.

In particular, picking up single stitches of the last course from the needle cylinder by means of pick-up hooks, overturning two semi-courses onto each other by means of a 180° rotation of two semi-arcs of hooks, and then linking the stitches still held by the pick-up hooks, are very complex operations requiring very precise mechanical members. An even small deformation of the pick-up hooks makes the linking very difficult or even impossible, due to the very limited mechanical tolerances.

There is therefore the need for new methods and devices able to reduce or to eliminate, partially or completely, the problems of the known methods and machines.

SUMMARY OF THE INVENTION

According to an aspect, to partially or completely overcome the drawbacks of the prior art, a method is provided for manufacturing tubular knitted articles on a circular knitting machine comprised of a needle cylinder, comprising the following steps:

knitting, by means of the needle cylinder, a tubular knitted article starting from an edge and ending with a toe;

after knitting the knitted tubular article, positioning coaxial with the needle cylinder a transfer unit, which is provided with a plurality of pick-up members arranged according to a circular ring divided into two circular half-rings which can be overturned over each other so that each pick-up member is engaged by a respective needle of the cylinder;

removing the stitches of the last-formed course by transferring each single stitch from the respective needle to a respective pick-up member;

removing the tubular article from the needle cylinder by means of the transfer unit;

overturning one of the circular half-rings of pick-up members onto the other of said circular half-rings of pick-up members, arranging the pick-up members of one circular half-ring in front of respective pick-up members of the other circular half-ring, so as to arrange two edge portions of the final edge of the tubular knitted article one onto the other;

joining the two opposite edge portions together by means of joining stitches formed in intermediate spaces between consecutive pairs of opposite pick-up members;

unloading the tubular article with the closed toe from the transfer unit.

Contrary to known methods, according to the present invention the joining stitches which connect the two edges of the toe are made in an intermediate space between the pick-up members whereon the last stitches, formed by the needles of the circular knitting machine, are engaged. Therefore, there is more space to make the joining stitches, and this operation is thus less critical.

The method is less subject to defects of the mechanical members, positioning errors or other inaccuracies, and it is therefore more reliable.

As it is known, during knitting the needles of the circular needle bed of the needle cylinder sequentially form loops defining so-called needle loops. Sinkers are inserted between adjacent needles, cooperating with the needles for forming loops. Between consecutive pairs of needle loops formed by adjacent needles of the cylinder, loops of yarn are formed, called sinker loops, in correspondence of the sinkers.

According to the method described herein, each pick-up member practically receives a needle loop transferred from a respective needle, with which the pick-up member is engaged when picking-up the article from the needle cylinder. The two edge portions of the toe that are arranged onto each other and shall be closed, are joined by means of stitches that connect sinker loops together, which are located intermediate between the needle loops engaged by the pick-up members. In other words, contrary to the prior art methods, wherein the joining stitches are formed in correspondence of opposite pairs of needle loops, while they are engaged with hooks or other pick-up members, in the method of the invention the joining stitches are formed in the area of the sinker loops.

It is not necessary for the joining stitches to be formed exactly on the last stinker loop, i.e. on the yarn portion joining the last loops of the last course formed by the needles and transferred to the pick-up members. On the contrary, the needle of the closing device can engage sinker loops of one or more of the last formed courses, for instance of the last ten courses, preferably of the last five formed courses, for instance of the last three or four formed courses. Generally, as the joining stitches are not made on the needle loops picked-up by the pick-up members, but in correspondence of the segments of yarn forming the sinker loops intermediate between adjacent pick-up members, the joining stitches can be distributed randomly, to a certain extent. For example, some joining stitches engage the sinker loops of the last formed course, while other joining stitches engage the sinker loops of the second, the third, the fourth to last course. Therefore, once the toe has been closed, in the same knitted article joining stitches can be provided, which are not all aligned on the same course, but distributed randomly, to a certain extent, between the last two, three, four or five courses.

Also in case the joining stitches involve sinker loops of courses before the last course, the finished article has a high level of finishing and high quality.

According to a further aspect, a system is described for producing tubular knitted articles comprised of a closed toe, the system comprising:

a circular knitting machine having a needle cylinder for knitting tubular articles;

a transfer unit for picking-up the tubular knitted articles, removing them from the needle cylinder and transferring them to a closing device, said transfer unit comprising a circular ring of pick-up members divided into two circular half-rings of pick-up members which can be overturned over each other, wherein each pick-up member is arranged and configured to receive a respective loop from a corresponding needle of the needle cylinder; said closing device being configured and controlled to co-act with the transfer unit to close the toe of the tubular knitted article while the tubular knitted article is engaged by the transfer unit.

Advantageously, the knitting machine, the transfer unit and the closing device are controlled and configured so that the closing device makes joining stitches for joining the two edges in intermediate positions between consecutive pairs of opposite pick-up members of the two half-rings of pick-up members.

Features and embodiments are described hereunder and further defined in the attached claims, which form an integral part of the present description. The above brief description identifies features of various embodiments of the present invention, in a manner that the detailed description below may be better understood and in order that the present contributions to the art may be better appreciated. There are obviously other features of the invention which will be described further on and which will be indicated in the attached claims. Before illustrating different embodiments of the invention in detail, it must be understood that the various embodiments of the invention are not limited in their application to the construction details and to the arrangements of components described in the following description or illustrated in the drawings. The invention may be implemented in other embodiments and implemented and placed in use in various ways. Also, it is necessary to understand that the phraseology and terminology used here are only for descriptive purposes and must not be considered as limiting.

Those skilled in the art will therefore understand that the concept on which the invention is based may be promptly used as a base for designing other structures, other methods and/or other systems to implement the various objects of the present invention. It is therefore important that the claims be considered as comprising those equivalent constructions which do not deviate from the spirit and scope of the present invention.

BRIEF DESCRIPTION OF THE DRAWINGS

The invention will be easier to understand by means of the description below and the attached drawing, which shows a non-restrictive embodiment of the invention. More particularly, in the drawing.

DETAILED DESCRIPTION OF AN EMBODIMENT

The following detailed description of exemplary embodiments refers to the accompanying drawings. The same reference numbers in different drawings identify the same or similar elements. Additionally, the drawings are not necessarily drawn to scale. Also, the following detailed description does not limit the invention. Instead, the scope of the invention is defined by the appended claims.

Reference throughout the specification to "n embodiment" or "the embodiment" or "some embodiments" means that the particular feature, structure or characteristic described in connection with an embodiment is included in at least one embodiment of the subject matter disclosed. Thus, the appearance of the phrase "in one embodiment" or "in an embodiment" or "in some embodiments" in various places throughout the specification is not necessarily referring to the same embodiment(s). Further, the particular features, structures or characteristics may be combined in any suitable manner in one or more embodiments.

Figure 1:
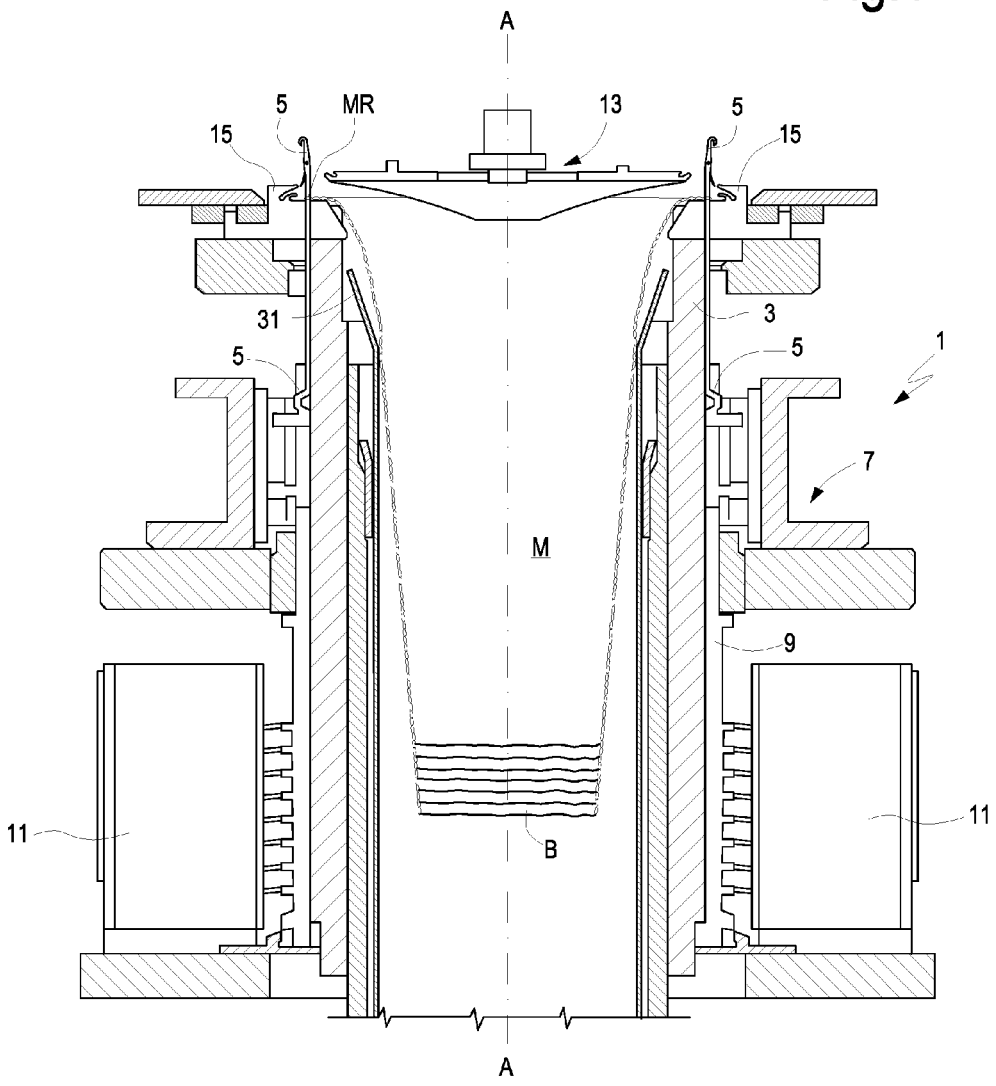
FIGS. 1 to 5 show subsequent positions of the transfer unit during the step of engagement with the needles of the knitting machine.

FIG. 1 shows a circular knitting machine in a final step of the knitting process of a tubular knitted article M, for instance a sock.

The circular knitting machine, indicated as a whole with number 1, has a needle cylinder 3 with a plurality of tracks for needles 5 forming a circular needle bed. The cams for controlling the needles are indicated with number 7, the jacks are indicated with number 9 and the selectors or actuators with number 11. All these knitting members are well known and will be not described in greater detail. The rotation axis of the needle cylinder 3 is indicated with A-A. In the illustrated embodiment, while knitting the tubular knitted article M the circular bed of needles 5 cooperates with a dial 13 positioned above, and coaxially with, the needle cylinder and provided with hooks controlled by corresponding cams, not shown. Number 15 indicates the sinkers associated with the needle cylinder 3, cooperating with the needles 5 and inserted therebetween.

Knitting of the tubular knitted article M starts by forming the elastic edge B and ends with the formation of the last course of stitches. In FIG. 1 the last course of stitches, indicated with MR, is engaged by the needles 5. The last course and, if necessary, the courses formed immediately before the last one, for example the penultimate, the third last and the fourth to last course, form the tail edge of the tubular knitted article M that shall be sewn or linked by means of joining stitches, to form the closed toe of the tubular knitted article M. In some embodiments one or more final courses, for instance the last 3-10 courses, may be knitted with an elastic yarn, for instance Lycra®.

The toe of the tubular knitted article M is closed by means of a closing device, outside of the circular knitting machine 1, whereto the tubular article M is transferred in the way described below. Typically, the closing device can comprise a linking machine or a sewing machine.

Figure 2:
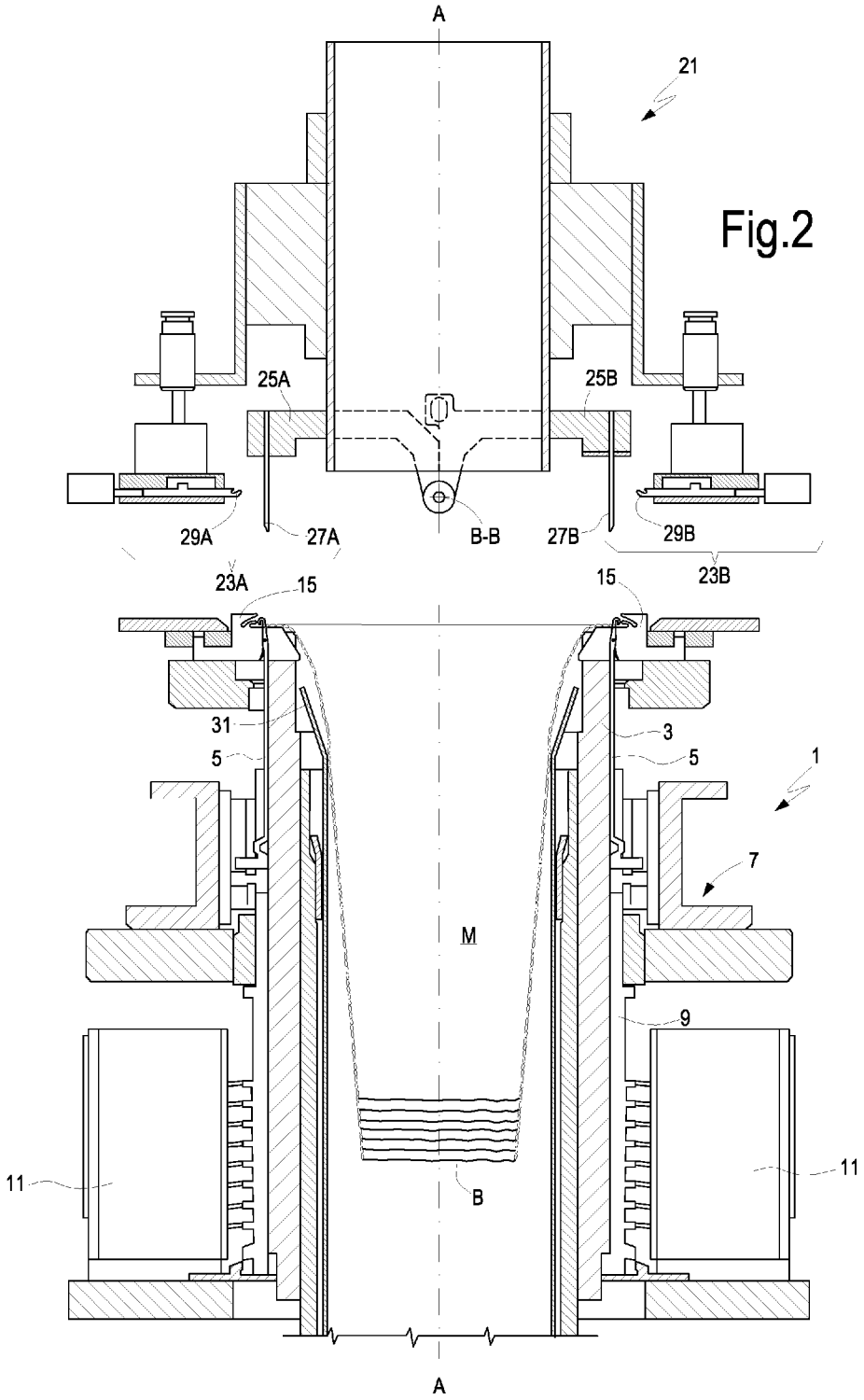

A transfer unit, indicated with number 21, is provided to pick-up the tubular article M from the needle cylinder 3, transfer it to the closing device, arrange two edge portions of the final edge of the tubular knitted article one onto the other, and close the toe. In FIG. 2, the dial 13 has been moved away from the needle cylinder and the transfer unit 21 is shown in coaxial position with the needle cylinder 3, ready to start the operations to pick-up the tubular article M.

The transfer unit 21 can comprise a plurality of pick-up means, indicated as a whole with number 23A, 23B.

In some embodiments, the pick-up means 23A, 23B comprise respective groups of punches 27A, 27B. The punches 27A, 27B constitute pick-up members and are arranged in a number corresponding to the number of needles 5 and at a pitch corresponding to the pitch of the needles 5, so that, when the tubular article M is picked-up from the needle cylinder 3, a respective pick-up member or punch 27A, 27B can be associated with each needle 5.

The pick-up members or punches 27A, 27B are arranged according to a circular ring, divided into two half-rings. Each half-ring of punches or pick-member 27A, 27B can comprise a respective semi-annular support 25A, 25B. In particular, the punches 27A are carried by the semi-annular support 25A, while the punches 27B are carried by the semi-annular support 25B. The two semi-annular supports 25A, 25B are hinged together around an axis B-B. In this way, it is possible to overturn one circular half-ring onto the other, for the purposes described later on. In the illustrated example, the semi-annular support 25B can be overturned around the axis B-B, while the semi-annular support 25A is fixed. The axis B-B is orthogonal to the axis A-A of the needle cylinder 3 when the transfer unit 21 is in the arrangement of FIG. 2, coaxial with the needle cylinder 3.

The punches 27A, 27B can be rigidly fixed to the semi-annular supports 25A, 25B and can be directed downwards approximately parallel to the axis A-A of the needle cylinder 3. In other embodiments, the punches 27A, 27B can be provided with a relative motion with respect to the semi-annular support, for instance with a pivoting movement to move the distal ends of the punches 27A, 27B towards the axis of the annular ring formed by said punches and away from it.

The punches 27A, 27B can be shaped so as to surround a respective needle 5 during the step of picking up the article M from the needle cylinder 3, as described in greater detail below.

The pick-up means can comprise, in addition to the pick-up members constituted by the punches 27A, 27B, respective posts or hooks 29A, 29B. A post or hook 29B, 29B can be associated with each punch 27A, 27B to transfer a loop from the respective needle 5 to the corresponding punch 27A, 27B and to keep the loop on the punch 27A, 27B while the tubular article M is removed from the needle cylinder 3 and transferred towards the closing device.

In some embodiments, the posts 29A, 29B are provided with a radial movement and an axial movement, i.e. a movement approximately horizontal and orthogonal to the axis A-A of the needle cylinder 3 and with a movement approximately vertical and parallel to the axis A-A of the needle cylinder 3. The two movements can be combined together into a rotary or pivoting movement or a combined movement of rotation and translation. In general, what is important is that the posts 29A, 29B are movable with respect to the corresponding punches 27A, 27B to transfer the single loop from the needle 5, which has formed it, to the respective punch 27A, 27B, as described below.

Figure 5:
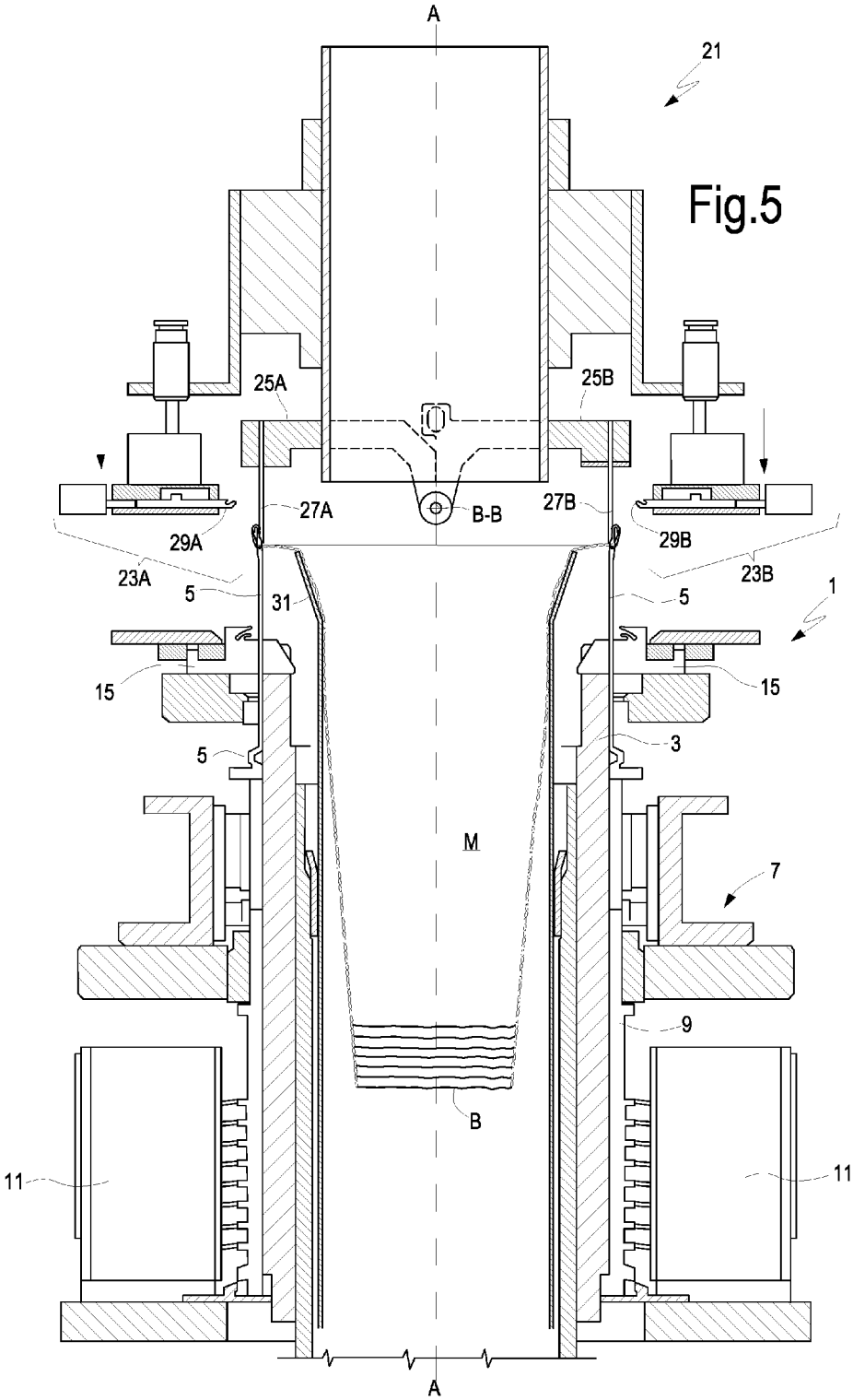
Figure 5A:
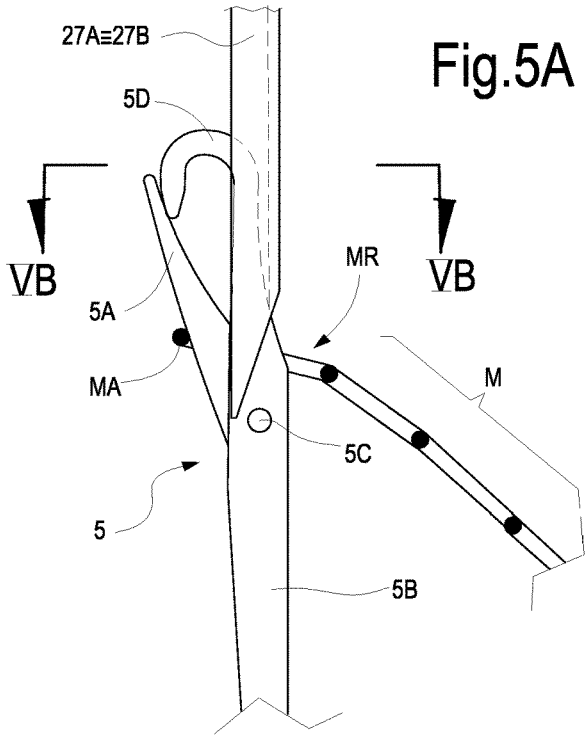
FIG. 5A shows the enlargement of a needle engaged with a respective pick-up member in the position of FIG. 5.

As it is known, and as shown in particular in the enlargement of FIG. 5A, each needle 5 is provided with a latch 5A pivoted at 5C with a needle shank 5B. The shank ends with a hook 5D which engages the yarn fed by the yarn guide of the machine 1 to form the loop. Advantageously, the punches 27A, 27B are shaped so as to surround the end part of the needle in the area between the hinge 5C and the needle head, i.e. the top of the hook 5D.

Figure 5B:
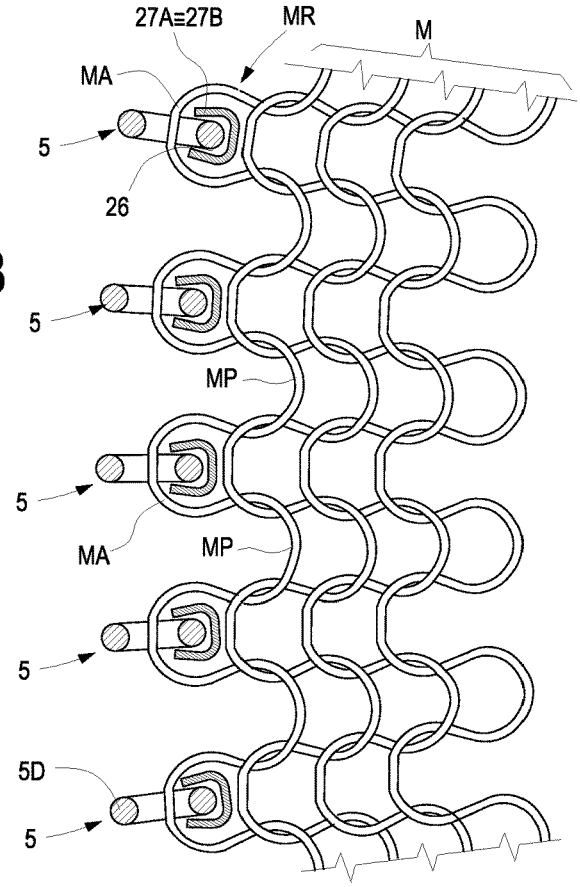
FIG. 5B shows a cross-section according to VB-VB of FIG. 5A.

FIG. 5B shows a cross section of the needles 5 and the respective punches 27A, 27B in the area where they surround the respective needle. In the illustrated embodiments, the punches 27A, 27B surround the respective needles 5 from the back, i.e. from the side facing the axis A-A of the needle cylinder 3. An opposite arrangement is also possible, wherein the punches 27A, 27B surround the respective needles from the outside, i.e. from the needle side facing opposite the axis A-A of the needle cylinder 3.

In the illustrated embodiment, the punches 27A, 27B have a groove or recess 26, inside which the end part of the respective needle 5 is inserted, to facilitate the transfer of the loops from the needle 5 to the punch 27A, 27B.

Figure 3:
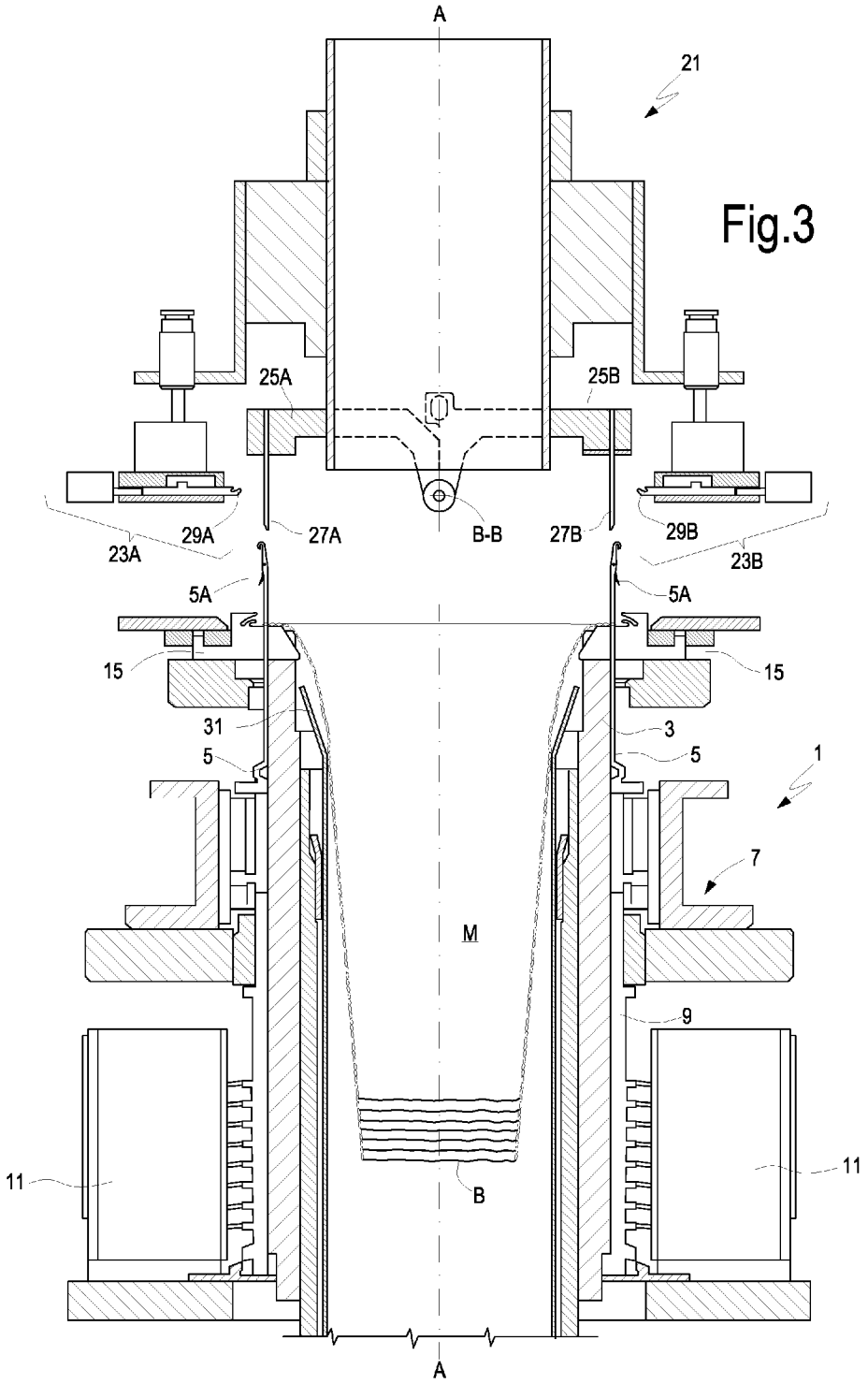

When knitting of a tubular knitted article M has been completed, the loops of the last course are engaged on the hooks 5D of the respective needles 5 and shall be removed from the respective needles 5 to be transferred on the punches 27A, 27B. This operation can be performed in various ways. In some embodiments, the needles 5 are raised from the loop-forming surface defined by the sinkers 15, while the sinkers 15 hold the formed knitted fabric. In this way, while he needles 5 move upwards, the loops engaged with the needles and held by the sinkers 15 slide along the shank 5B of the respective needles 5, until they achieve a height lower than that of the respective latches 5A of the needles 5, as shown in FIG. 3.

At this point, each needle 5 can be coupled to the respective punch 27A, 27B by surrounding the hook 5D of each needle 5 with the respective punch 27A, 27B. Moreover, the tubular knitted article M can be raised by sliding the last loops thereof along the shanks 5B of the needles 5 until they are brought near the hooks 5D of the needles 5. The tubular knitted article M can be raised for instance by means of a tubular member 31 that is inside the needle cylinder 3 and is nearly coaxial therewith. The tubular member 31 is axially movable so that it can be partially extracted upwards.

Figure 4:
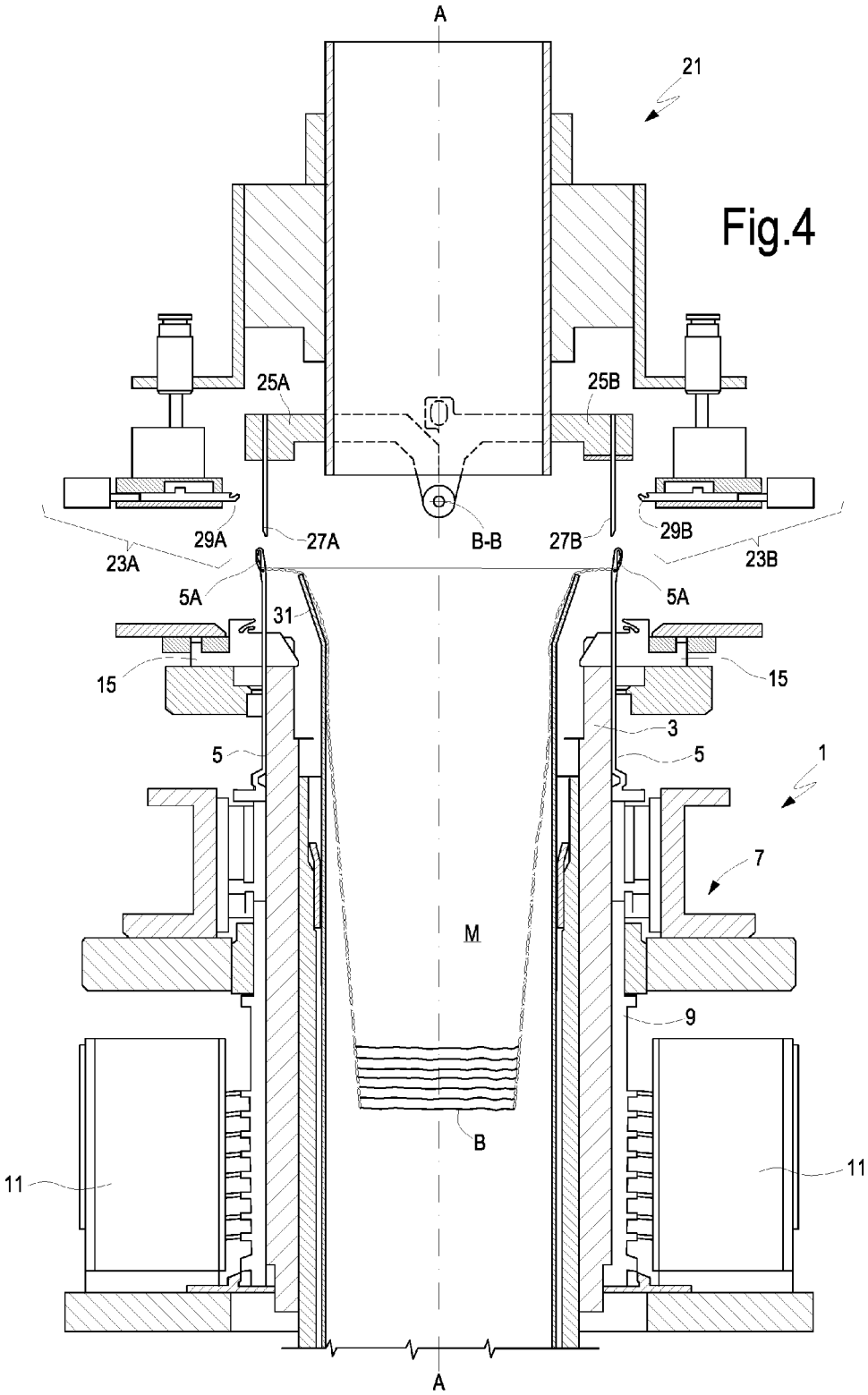

In FIG. 4, the tubular member 31 is in a partially raised position, while in FIG. 5 the tubular member 31 is completely raised and has brought the loops of the last course near the hooks 5D of the needles 5. In this upward movement of the loops, the loops pass in front of the latches 5A, raising them in a closing position, so that the latches 5A form a bridge allowing the loops to slide outside of the hooks 5D of the needles 5.

At the same time, the transfer unit 21 is arranged, with respect to the needles 5, so that each punch 27A, 27B is coupled to the respective needle 5. FIG. 5A shows an enlargement of a needle 5 with the respective loop MA formed thereby, wherein the punch 27 (27A or 27B) is coupled to the needle 5. FIG. 5B shows a cross-section according to line VB-VB in FIG. 5A. FIG. 5B shows the loops MA engaged with the needles 5, the punches 27, each of which surrounds a needle 5, and a series of loop courses formed during the last rotations of the needle cylinder 3, before the last course of loops MA has been formed.

As shown in FIG. 5B, each loop MA engaged by a respective needle 5 is substantially constituted by a yarn stitch. As mentioned above, this loop is usually called needle loop. Between a loop MA and the other one, the yarn forming the loops MA forms intermediate loops, defining so-called sinker loops, indicated with MP in FIG. 5B. Practically, the knitted fabric is formed by a sequence of courses, in each of which needle loops MA, constituted by the loops formed around the needle, alternate with sinker loops MP, constituted by loops formed in correspondence of the sinkers 15 between adjacent needle loops MA.

Figure 6:
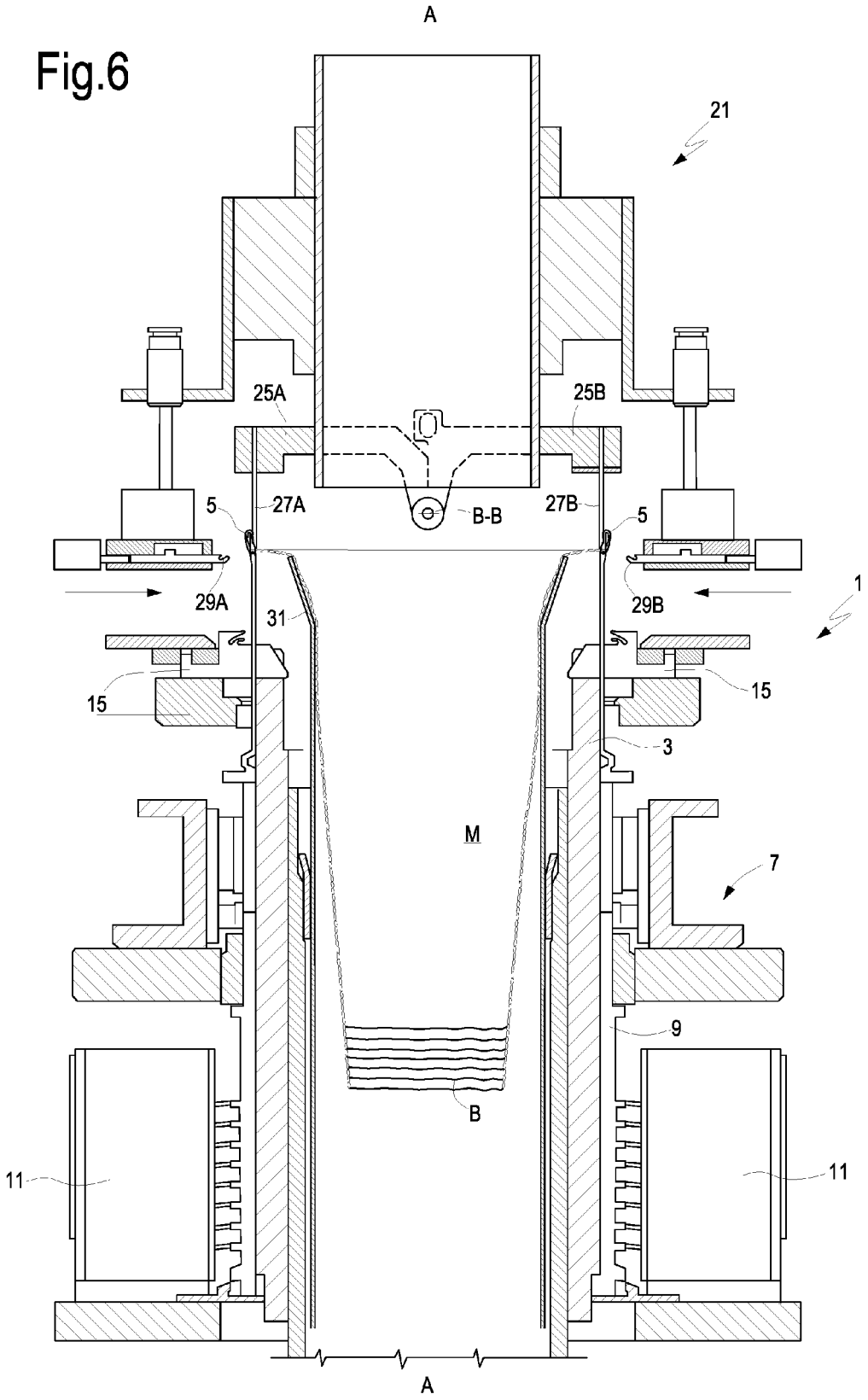
FIGS. 6 and 7 show subsequent steps of the loop transfer from the needles to the pick-up members.

In the illustrated embodiment, the posts 29 are used to transfer the single loops MA from the respective needles 5 to the punches 27. In FIG. 6, the posts 29A, 29B have moved radially inwards, and in FIG. 7 they have been also raised to approach the punches 27A, 27B, each post lifting a respective loop MA. The loops MA are thus transferred on the punches 27A, 27B.

Figure 7A:
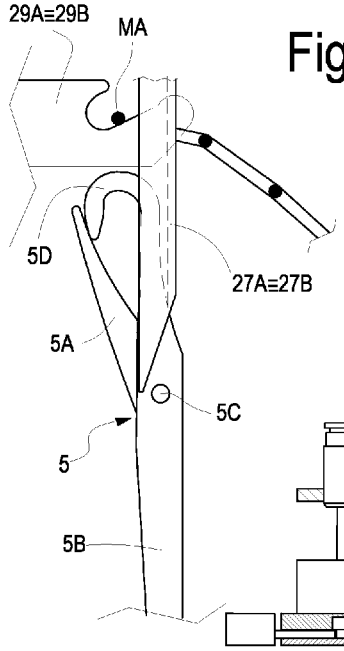
FIG. 7A shows the enlargement of a needle and a respective pick-up member in the arrangement of FIG. 7.
Figure 7:
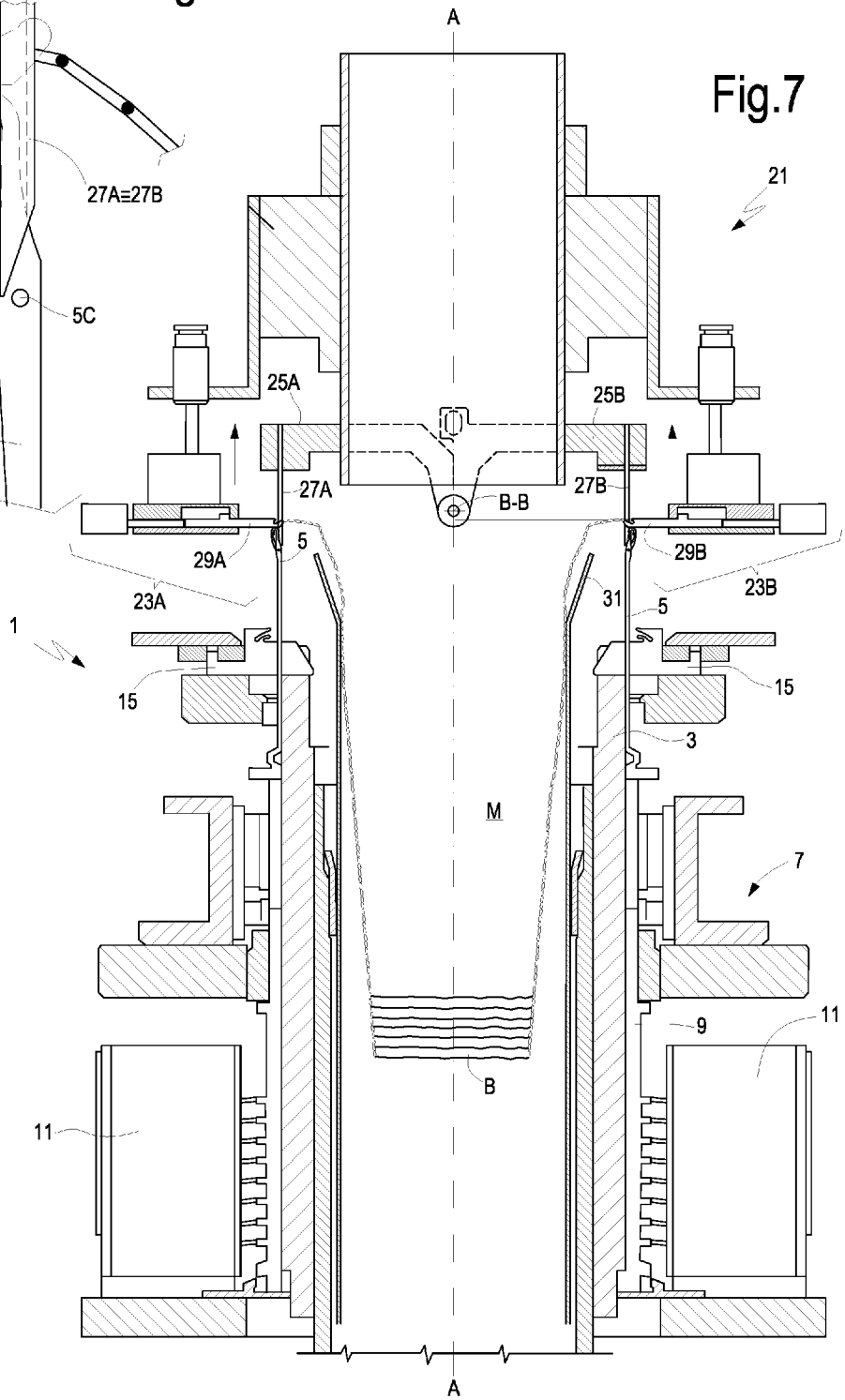

FIG. 7A shows an enlargement of a needle 5 coupled to the respective punch 27, with the raised post 29 that has moved the loop MA on the punch 27 and holds said loop thereon, thus clearing the needle 5.

At this point, the tubular knitted article M has been completely removed from the needles 5 and transferred to the transfer unit 21, engaging each needle loop MA of the last course with the punches 27A, 27B. The whole tail edge of the tubular knitted article M, that shall be closed to form the closed toe of the article, is engaged by the punches 27A, 27B. Practically, a first portion of the tail edge is engaged with the punches 27A of a first half-ring of pick-up members, and a second portion of the tail edge is engaged with the punches 27B of the second half-ring of pick-up members.

The subsequent operations provide the following: removing the tubular knitted article M from the circular knitting machine 1, transferring the knitted article towards the closing device, reversing the tubular knitted article, overturning the punches 27A, 27B one over the other, transferring the loops MA from the punches 27A to the punches 27B or vice versa, so as to couple together the corresponding loops of the two end portions of the tail edge, and forming joining stitches, i.e. sewing or linking stitches.

Figure 8:
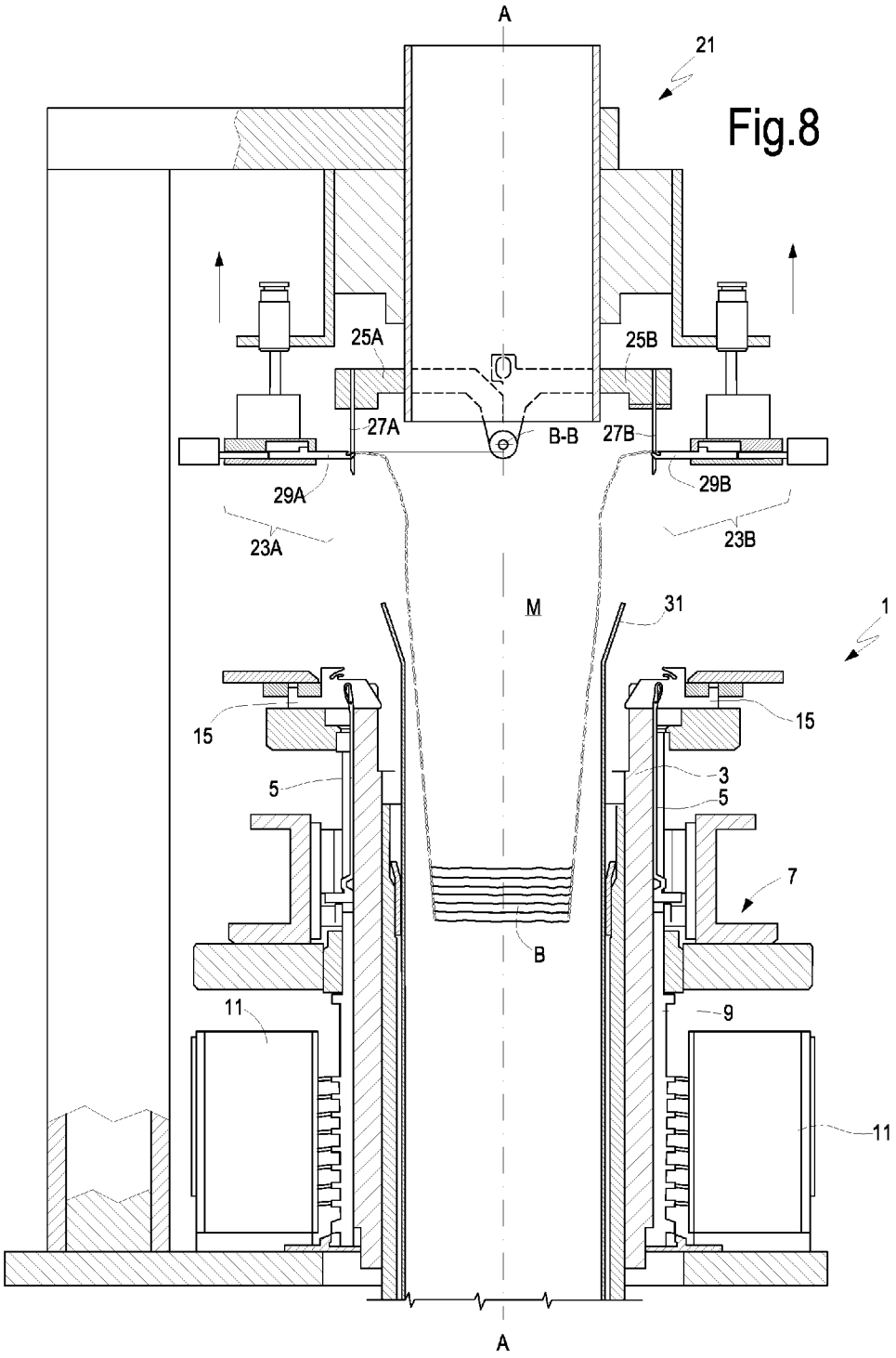
FIGS. 8 and 9 show steps wherein the tubular knitted article moves away from the knitting machine towards a toe closing device.
Figure 9:
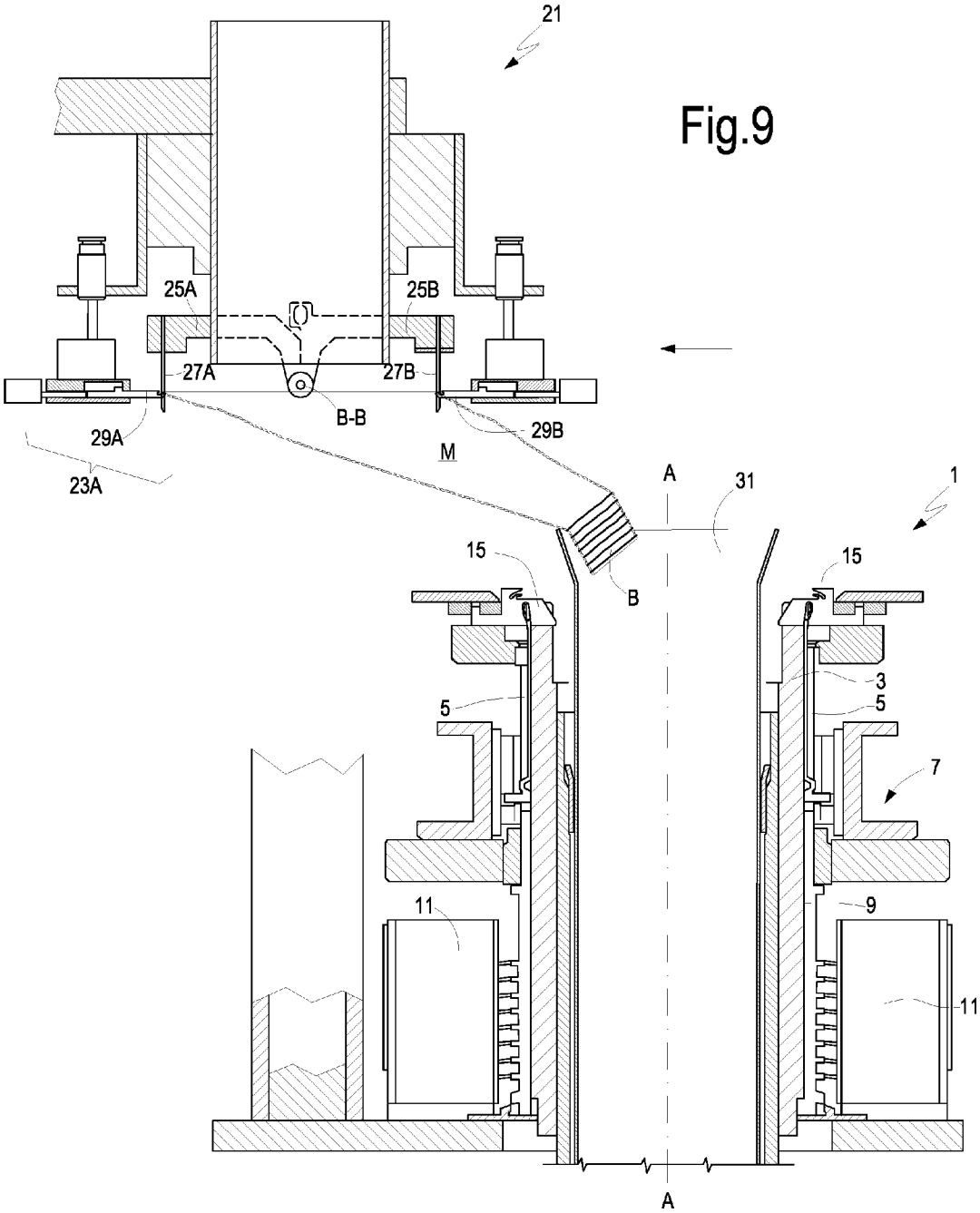
Figure 10:
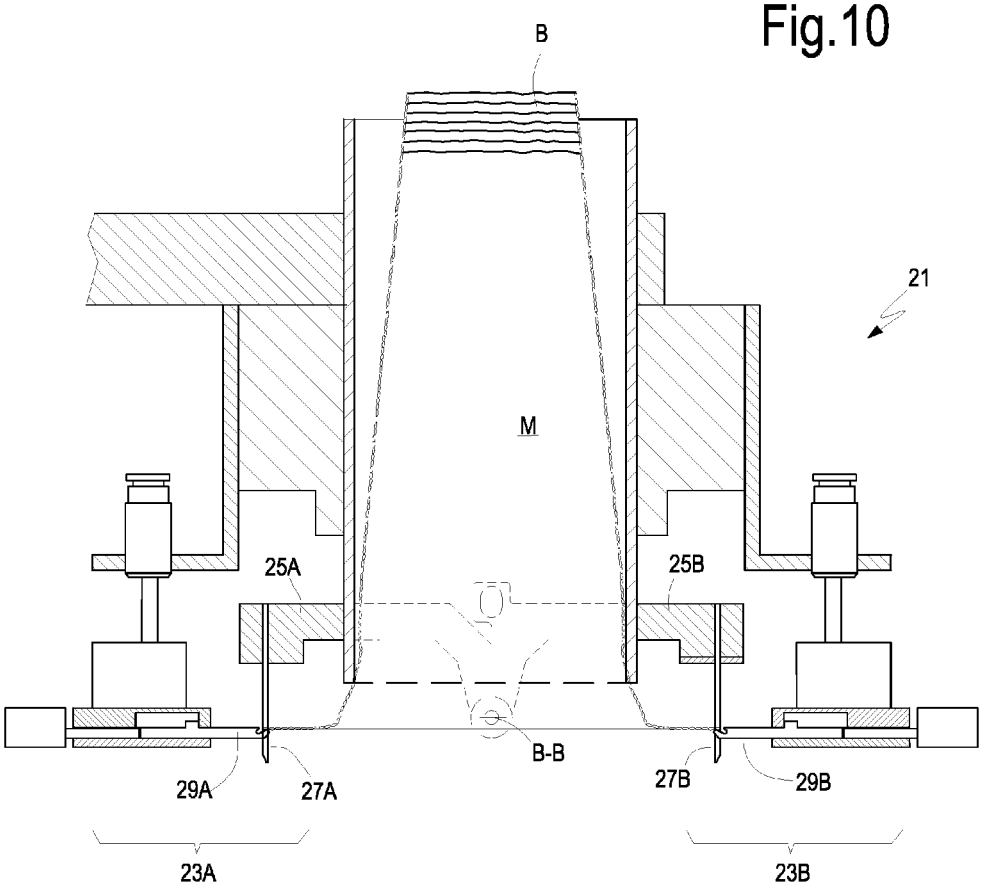
FIG. 10 shows a step of reversing the tubular knitted article.

In FIGS. 8 and 9, the transfer unit 21 is moving away from the needle cylinder 3 of the machine 1, while in FIG. 10 the step is shown wherein the tubular knitted article M is reversed.

All these operations can be performed in a known manner.

Figure 11:
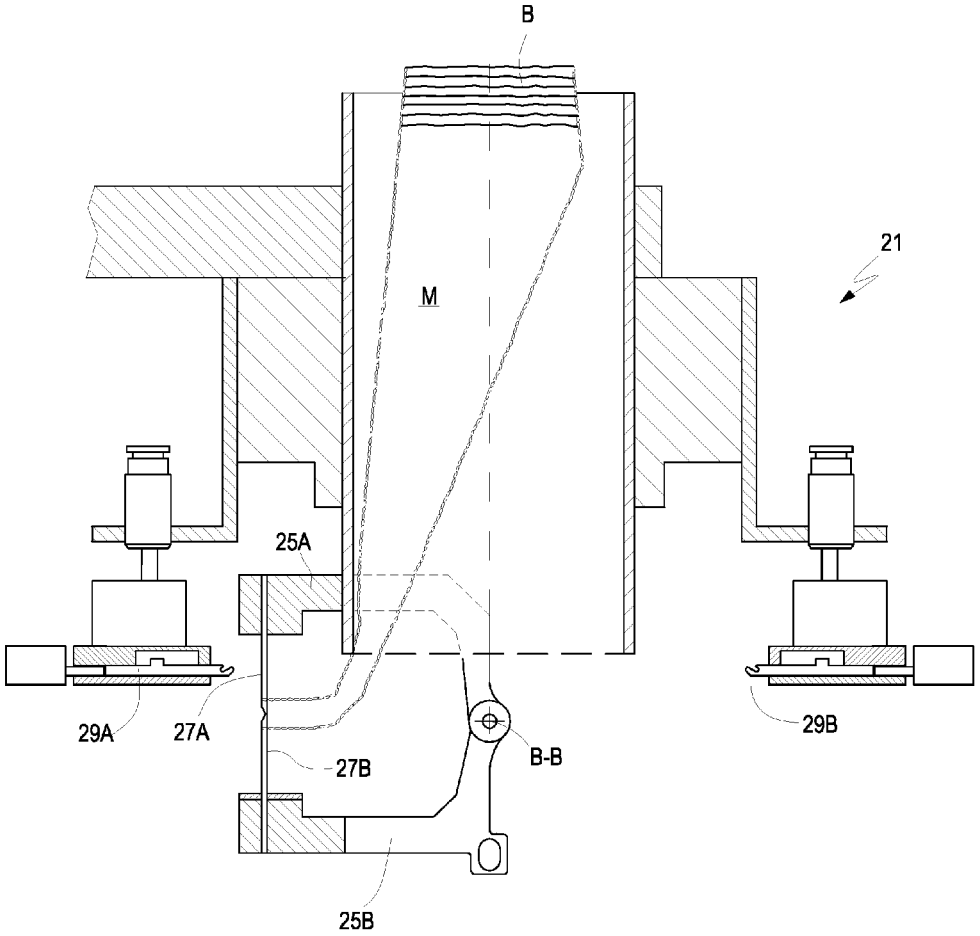
FIGS. 11 to 13 show toe closing steps.

In FIG. 11, the semi-annular support 25B has been overturned by about 180° onto the semi-annular support 25B, so as to bring each punch 27B in front of a corresponding punch 27A and aligned therewith. Each loop MA is still engaged with the punch 27A, 27B, whereon it has been transferred during the previous step.

Figure 12:
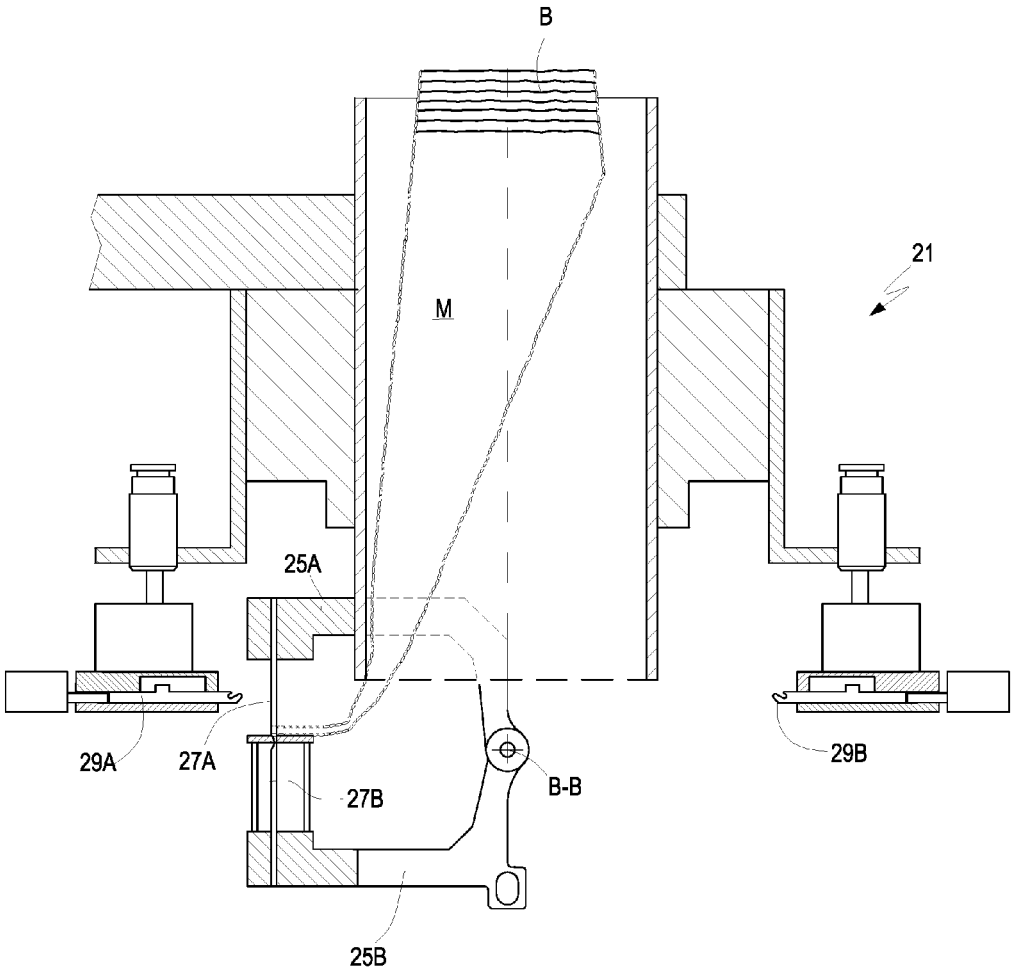

FIG. 12 shows the step of transferring the loops MA from the punches 27B to the punches 27A. At the end of this step, the two opposite edges of the toe to be closed of the tubular knitted article are engaged by the punches 27A of the first half-ring, while the second half-ring is empty.

Figure 13:
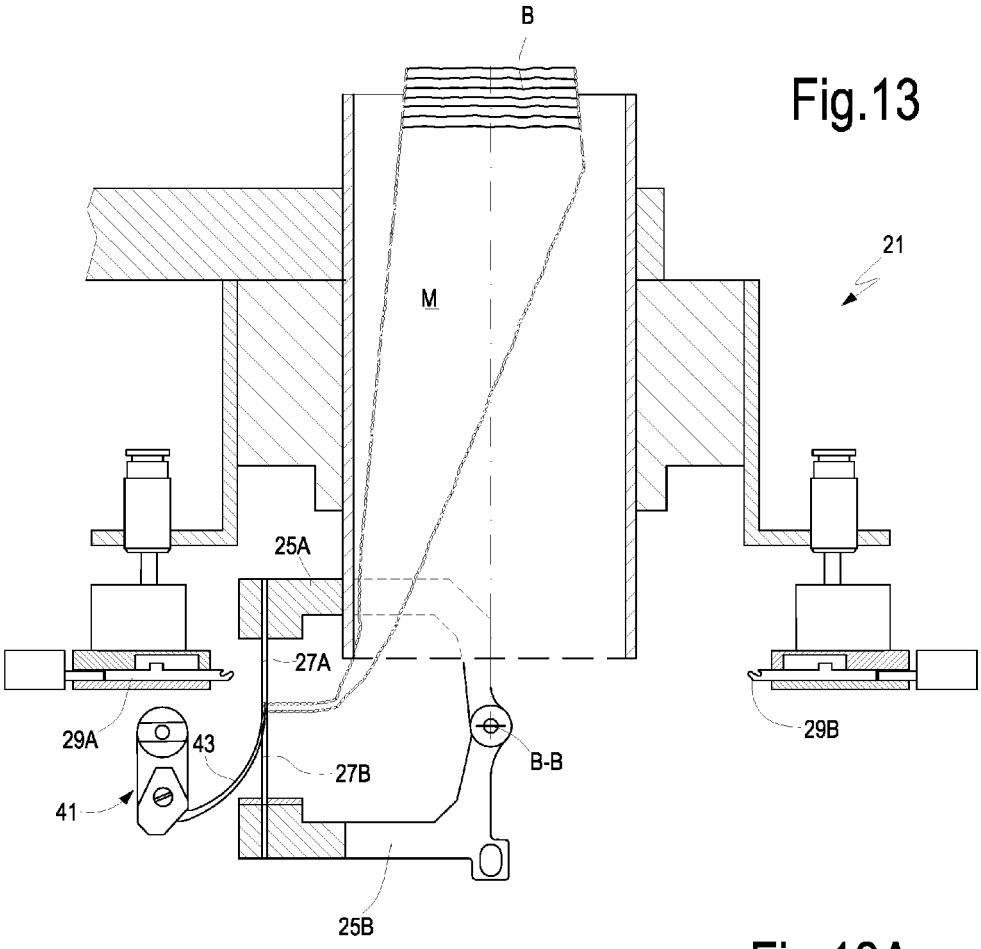

FIG. 13 shows the toe closing step. The toe is advantageously closed by means of a substantially linking process performed by a linking machine or other closing device, schematically indicated by number 41, provided with at least a needle 43. There are different closing devices, which can sew or link. In some embodiments, the closing devices comprise a single needle. In other embodiments, they have a double sewing or linking member, typically comprising a needle and a hook (crochet). These devices are known and do not require further detailed description.

The closing operations are performed by gradually rotating the transfer unit 21, and therefore the two semi-course of loops put over one another and engaged by the pick-up members 27A, around the vertical axis of the transfer unit 21, so that the needle, or other closing member of the device 41, sequentially makes the sewing or linking stitches, by sequentially penetrating into the spaces between consecutive pick-up members or punches 27A.

Characteristically, and differently than what occurs in the prior art, the needle 43 of the closing device 41 forms joining stitches between adjacent punches 27A, thus connecting to one another, by means of the joining stitches, the sinker loops MP instead of the needle loops MA engaged by the punches 27A. One joining stitch is preferably made for each column of sinker loops. In this way, a linking is substantially performed, wherein each joining stitch represents a linking stitch joining a single sinker loop of a portion of the tail edge of the tubular knitted article M with a corresponding sinker loop of the other portion. Advantageously, the number of linking stitches corresponds to the number of columns of sinker loops.

Figure 13A:
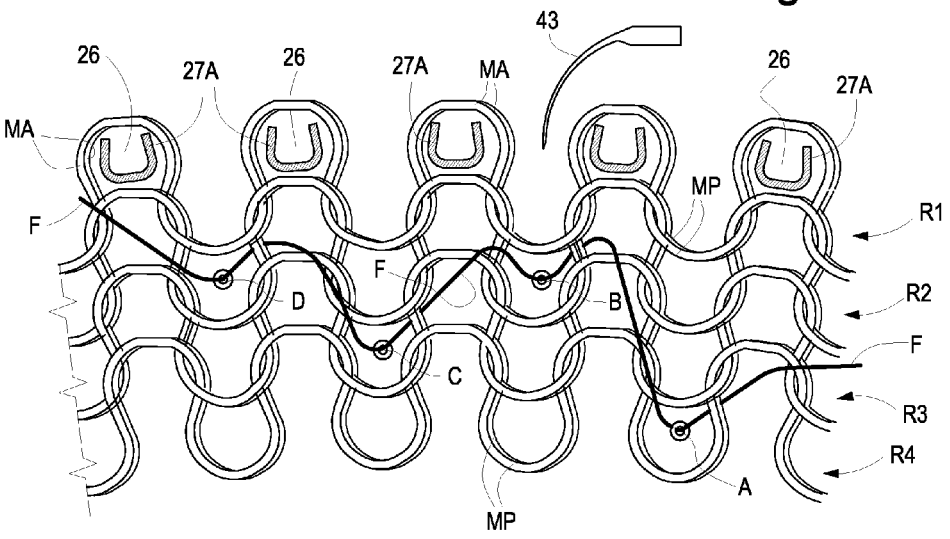
FIG. 13A shows an enlargement of the pick-up members and the needle of the closing device in the toe closing step.

FIG. 13A shows a schematic enlargement of this toe closing operation for the tubular knitted article M. References A, B, C, D indicate the possible positions where the needle 43 of the closing device 41 can penetrate in the sinker loops MP. Reference F indicates the joining yarn forming the joining stitches. In the illustrated example, the two tail edge portions have been closed by means of a single yarn in a closing device advantageously provided with a single needle. It is also possible to close the two portions with two yarns, using closing devices with needle and hook (crochet).

Still referring to FIG. 13A, references R1, R2, R3, R4 indicate the last four courses forming the tail edge of the tubular knitted article M. The loops MA and MP of the courses R1, R2, R3, R4 are double, as in this step the two opposite tail edge portions are arranged one onto the other and coupled, and are engaged with the punches 27A of a half-ring, as described above.

As the joining stitches are formed in the intermediate area between adjacent punches 27A, instead of at said punches, these joining stitches do not involve the needle loops MA, held by the punches 27A, but the sinker loops MP, that are not mechanically held in a precise point. For this reason, it is possible that the needle 43 of the closing device does not always make the joining stitches on the sinker loops MP of the last course, but for instance of one of the last four course R1-R4, as schematically indicated in FIG. 13A. Nevertheless, high quality in the toe closing is achieved.

Preferably, the closing device 41 makes a single joining stitch for each pair of adjacent punches 27A, thus achieving a join of the two portions substantially constituted by a linking.

Figure 14:
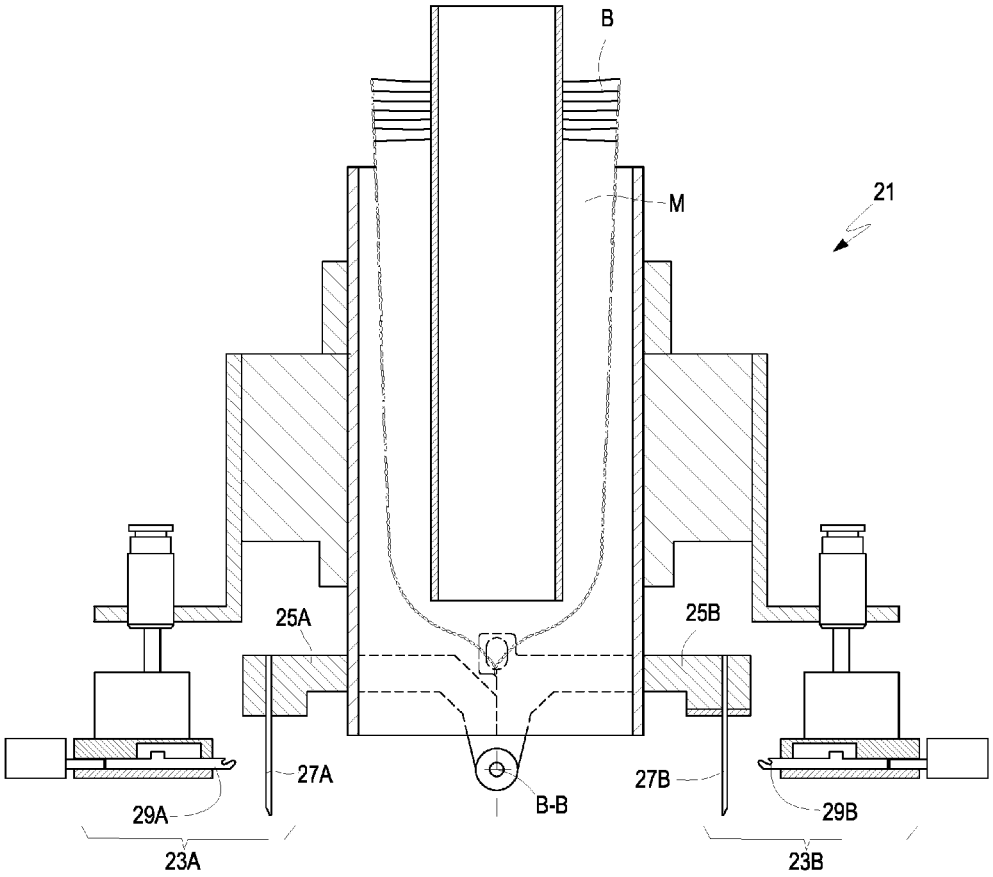
FIGS. 14 and 15 show the removal of the tubular knitted article after the toe has been closed, and the start of the second reversing step.
Figure 15:
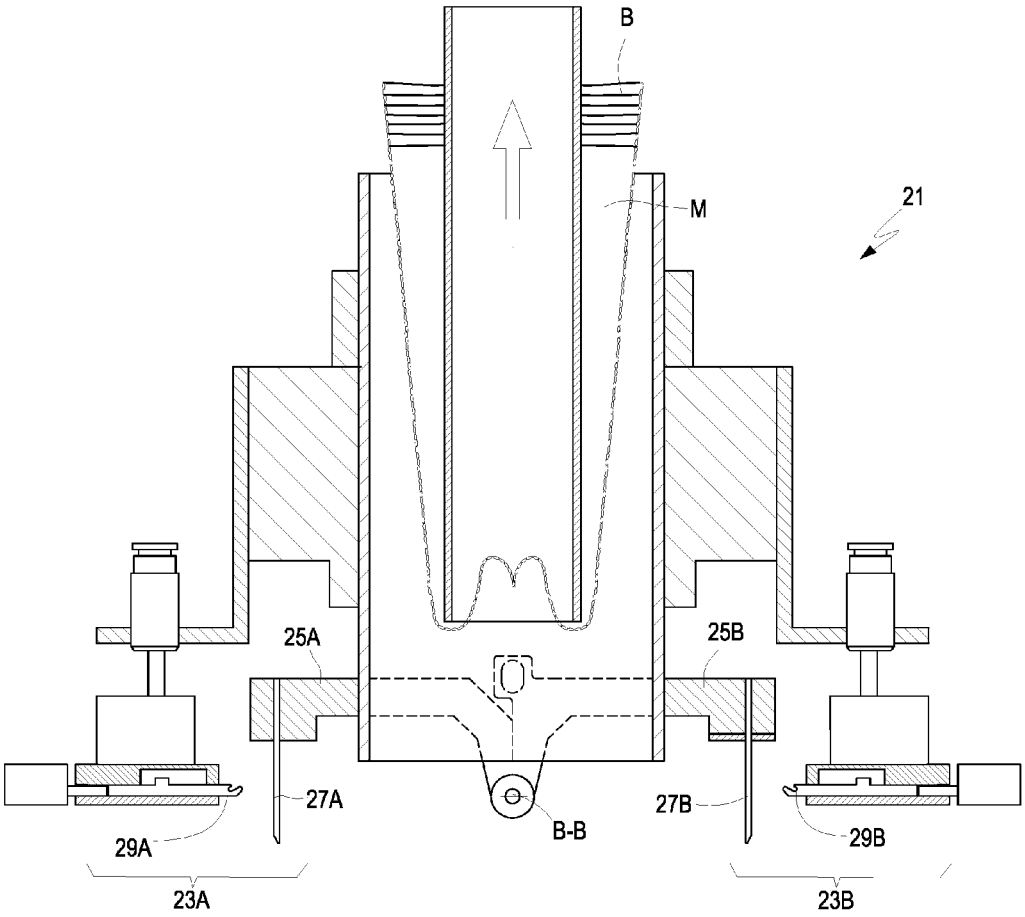

Once the toe of the tubular article M has been closed, the tubular article can be removed from the punches 27A and reversed, in a known manner, as shown in the sequence of FIGS. 14 and 15. In the illustrated embodiment, the second reversing of the tubular article can be made by means of a suction tube inserted inside the transfer unit 21.

The above description refers to a possible configuration of the transfer unit and the pick-up members. Many systems are known in the prior art to pick-up the single needle loops from the needles of the needle cylinder of a knitting machine. As the method of the invention does not differ from other known methods as regards picking-up of the needle loops MA from the needles 5 of the knitting machine 1, to perform this operation any one of the devices known in the art can be used. What is important is that the single loops of the last course are transferred from the needles that have formed them to single pick-up members and held thereon to remove the tubular knitted article from the needle cylinder. It is also important to overturn a half-ring of the pick-up members onto the other, to reciprocally couple each loop of a tail edge portion to a corresponding loop of the other portion. Also the transfer of the loops of a portion onto the pick-up members engaging the loops of the other portion can be performed by means one of the many prior art systems.

The pick-up means 23A, 23B, with the posts 29A, 29B and the punches or pick-up members 27A, 27B have been shown and described just by way of examples of pick-up members, which can be also configured in a substantially different manner.

Similarly, the members reversing the tubular knitted article before and, if necessary, after the toe closing can be different than those illustrated herein.

The structure of the closing device 41 can be different than that illustrated herein by way of example. What is important is that this device makes the joining stitches on the sinker loops, i.e. in the intermediate areas between adjacent pick-up members, benefitting from the greater space available there, and without the need for an accurate mechanical cooperation between needle 43 of the closing device 41 and pick-up members.

In some embodiments, the method of the present invention provides for making at least one last course or some last courses of stitches run-proof. In this way, when the pick-up means 23A, 23B take the loops MA from the needle and transfer the tubular knitted article from the needle cylinder to the closing device 41, overturning a half-course of stitches onto the other, there is no risk of runs in the article. The production of run-proof courses of stitches is known in the art and does not require detailed explanation. For example, U.S. Pat. No. 3,046,768, U.S. Pat. No. 5,426,957, U.S. Pat. No. 5,115,650, U.S. Pat. No. 2,379,649, U.S. Pat. No. 3,430,462, U.S. Pat. No. 3,751,942, U.S. Pat. No. 3,470,715, U.S. Pat. No. 4,005,589 disclose examples of methods, devices and technique that can be employed to form run-proof courses. U.S. Pat. No. 5,992,182 discloses a particularly effective method usable in the method of the present invention. The content of the above mentioned patents is incorporated in the present description.

Moreover, in some embodiments one or more courses of final loops can be made with an elastic yarn, for example Lycra®.

While the disclosed embodiments of the subject matter described herein have been shown in the drawings and fully described above with particularity and detail in connection with several exemplary embodiments, it will be apparent to those of ordinary skill in the art that many modifications, changes, and omissions are possible without materially departing from the novel teachings, the principles and concepts set forth herein, and advantages of the subject matter recited in the appended claims. Hence, the proper scope of the disclosed innovations should be determined only by the broadest interpretation of the appended claims so as to encompass all such modifications, changes, and omissions. In addition, the order or sequence of any process or method steps may be varied or re-sequenced according to alternative embodiments. Any reference numerals in the appended claims are provided to facilitate reading of the claims with reference to the description and to the drawing, and do not limit the scope of protection represented by the claims.

The invention claimed is:

1. A method for manufacturing a tubular knitted article on a circular knitting machine comprised of a needle cylinder, the method comprising the following steps:

knitting a tubular knitted article with the needle cylinder, starting from an initial edge and ending at a final edge forming a toe of the tubular knitted article;

after knitting the tubular knitted article, arranging a transfer unit coaxial with the needle cylinder, the transfer unit being provided with a plurality of pick-up members arranged according to a circular ring divided into two circular half-rings which can be overturned over each other, each of the plurality of pick-up members engaging a respective needle of the needle cylinder;

discharging loops of a last-formed course of loops by transferring each single loop from the respective needle, which has formed the loop, onto a corresponding pick-up member which engages the needle;

removing the tubular knitted article from the needle cylinder by means of the transfer unit;

overturning one of the two circular half-rings of pick-up members onto another one of the two circular half-rings of pick-up members, arranging the pick-up members of one circular half-ring in front of respective pick-up members of the another one of the two circular half-ring, so as to arrange two edge portions of the final edge of the tubular knitted article one onto another;

joining the two edge portions to one another by means of joining stitches formed in intermediate spaces between contiguous pick-up members, whereon the tubular knitted article is retained; and unloading the tubular knitted article with a closed toe from the transfer unit.

2. A method according to claim 1, wherein each of the pick-up members receives a needle loop transferred from the respective needle of the needle cylinder, the two edge portions of the final edge being joined to one another by means of joining stitches which join to one another sinker loops arranged between the needle loops engaged by the pick-up members.

3. A method according to claim 1, wherein after overturning the one of the two circular half-rings of pick-up members onto the another one of the two circular half-rings of pick-up members, the loops engaged by the pick-up members of a first one of the two circular half-rings of pick-up members are transferred onto the pick-up members of a second one of the two circular half-rings of pick-up members, such as to arrange two loops on each pick-up member of the second one of the two circular half-rings of pick-up members.

4. A method according to claim 1, wherein joining the two edge portions comprises forming a single joining stitch in each intermediate space between two consecutive pick-up members of one of the two circular half-rings of pick-up members.

5. A method according to claim 1, further comprising:

turning the tubular knitted article inside out before joining the two edge portions.

6. A method according to claim 5, further comprising:

turning the tubular knitted article inside out once again after closing the toe by joining the two edge portions.

7. A method according to claim 1, wherein one or more end courses of the tubular knitted article are run-proof courses.

8. A method according to claim 1, wherein one or more end courses of the tubular knitted article are formed with an elastic yarn.

9. A system for producing tubular knitted articles comprised of a closed toe, the system comprising:

a circular knitting machine having a needle cylinder for knitting tubular knitted articles, the needle cylinder having a circular needle bed;

a closing device for closing a toe of the tubular knitted articles;

a transfer unit for picking up and removing at least one of the tubular knitted articles from the needle cylinder and transferring the at least one of the tubular knitted articles to the closing device, the transfer unit comprising a circular ring of pick-up members, the circular ring of pick-up members being subdivided into two circular half-rings of pick-up members, which can be overturned one onto another, wherein each of the pick-up members is arranged and configured to engage a corresponding needle of the needle cylinder and receive a respective last loop from the corresponding needle, the respective last loop being formed by the corresponding needle, the closing device being configured and controlled to co-act with the transfer unit to close the toe of the at least one of the tubular knitted articles while last loops are engaged by the pick-up members of the transfer unit, the circular knitting machine, the transfer unit, the pick-up members and the closing device being controlled and configured such that the closing device forms stitches joining two portions of a final edge of the at least one of the tubular knitted articles in intermediate positions between adjacent pick-up members whereon the last loops of the at least one of the tubular knitted articles are engaged.

10. A system according to claim 9, wherein the closing device comprises at least one closing device needle, controlled to be introduced between the adjacent pick-up members, whereon the last loops of the final edge of the at least one of the tubular knitted articles are engaged, and to join to one another sinker loops arranged between the last loops engaged onto the pick-up members.

11. A method according to claim 2, wherein after overturning the one of the two circular half-rings of pick-up members onto the another one of the two circular half-rings of pick-up members, the loops engaged by the pick-up members of a first one of the two circular half-rings of pick-up members are transferred onto the pick-up members of a second one of the two circular half-rings of pick-up members, such as to arrange two loops on each pick-up member of the second one of the two circular half-rings of pick-up members.

12. A method according to claim 2, wherein joining the two edge portions comprises forming a single joining stitch in each intermediate space between two consecutive pick-up members of one of the two circular half-rings of pick-up members.

13. A method according to claim 2, further comprising:

turning the tubular knitted article inside out before joining the two edge portions.

* * * * *